US005762120A

United States Patent [19]

Smith

[11] Patent Number: 5,762,120

[45] Date of Patent: Jun. 9, 1998

[54] THREADED JAR FUNNEL

[76] Inventor: Alan Smith, Box 1208, Beaver, Utah 84713

[21] Appl. No.: 586,299

[22] Filed: Jan. 16, 1996

[51] Int. Cl.[6] ..... B65B 39/00

[52] U.S. Cl. ..... 141/340; 141/331

[58] Field of Search ..... 141/331, 340–343, 141/319–321

[56] References Cited

U.S. PATENT DOCUMENTS

| | | | |
|---|---|---|---|
| 641,267 | 1/1900 | Cahill | 141/340 X |
| 1,733,261 | 10/1929 | Higby et al. | 141/340 X |
| 2,694,515 | 11/1954 | Green | 141/340 X |
| 2,703,670 | 3/1955 | Voight | 141/340 |
| 3,156,272 | 11/1964 | Indrunas | 141/319 |
| 3,982,570 | 9/1976 | Devoe | 141/95 |
| 4,108,220 | 8/1978 | Pantek | 141/98 |
| 4,217,940 | 8/1980 | Wheeler | 141/340 X |
| 4,273,166 | 6/1981 | Bradley | 141/340 X |
| 5,074,343 | 12/1991 | Tyree, Jr. | 141/331 X |
| 5,168,908 | 12/1992 | Boyum | 141/340 |

FOREIGN PATENT DOCUMENTS

| | | | |
|---|---|---|---|
| 2048921 | 2/1993 | Canada | 141/319 |

*Primary Examiner*—J. Casimer Jacyna

*Attorney, Agent, or Firm*—Knobbe, Martens, Olson & Bear, LLP

[57] ABSTRACT

A threaded jar funnel for easy pouring of material into a jar, without leakage or spillage, has an upper part, with upper and lower conical segments, and a lower cylindrical part having threads on the inside. The upper conical segment of the upper part has a small angle to the vertical and the lower conical segment has a larger angle to the vertical than the upper conical segment. The upper conical segment merges into the lower conical segment to provide an aesthetically pleasing appearance, larger funnel capacity and smoother flow of contents into a jar coupled to the funnel. The lower cylindrical threaded part has a rim, which provides a tight seal when the funnel is coupled to a jar.

11 Claims, 3 Drawing Sheets

THREADED JAR FUNNEL

BACKGROUND OF THE INVENTION

1. Field of the Invention

The present invention relates to funnels for jars, more specifically funnels which facilitate pouring materials into jars which have threads on them.

2. Description of the Related Art

Conventional funnels have an upper conical part, with a top opening larger than the inner diameter of the mouth of the jar and a bottom opening smaller than the inner diameter of the mouth of the jar so that the funnel can be inserted into the mouth of the jar.

SUMMARY OF THE INVENTION

The present inventor recognized that conventional funnels do not provide for stable and tight coupling between the funnel and the jar. In the present invention, an engaging member such as threads is provided on the funnel so that the funnel can be firmly affixed to the mouth of jars. In a preferred embodiment, threads are provided on the inside of a lower, cylindrical part of the funnel for jars with threads on the outside of the mouth. In an alternative embodiment, the threads are provided on the outside of the lower, cylindrical part of the funnel for jars with threads on the inside of the jar mouth. This provides for tight coupling between the jar and the funnel and reduces the chance of spills. Other engaging configurations are also disclosed.

In addition to the threads, the lower cylindrical part of the funnel has a rim, above the threads. The rim covers the rim of the jar mouth and thereby facilitates a tight, stable coupling between the funnel and the jar and a tight seal between the funnel and the jar. The rim also prevents leakage of the contents of the funnel between the funnel threads and jar threads during pouring.

The funnel has an upper conical part which has two segments in the present embodiment, a top segment having a smaller angle with respect to vertical than a lower segment, which has a larger angle with respect to vertical. Preferably, the top segment merges smoothly into the lower segment to produce an aesthetically pleasing appearance. This shape increases the capacity of the funnel as compared to a single segment cone-shaped funnel, and provides for a smoother flow of the contents of the funnel into the jar. In the present embodiment, the lower segment of the upper part joins smoothly with the lower cylindrical threaded part. The funnel is machined form aluminum or the like in one embodiment and is molded from plastic in another embodiment. Other suitable materials could also be used.

DETAILED DESCRIPTION OF THE PREFERRED EMBODIMENT

Figure 1:
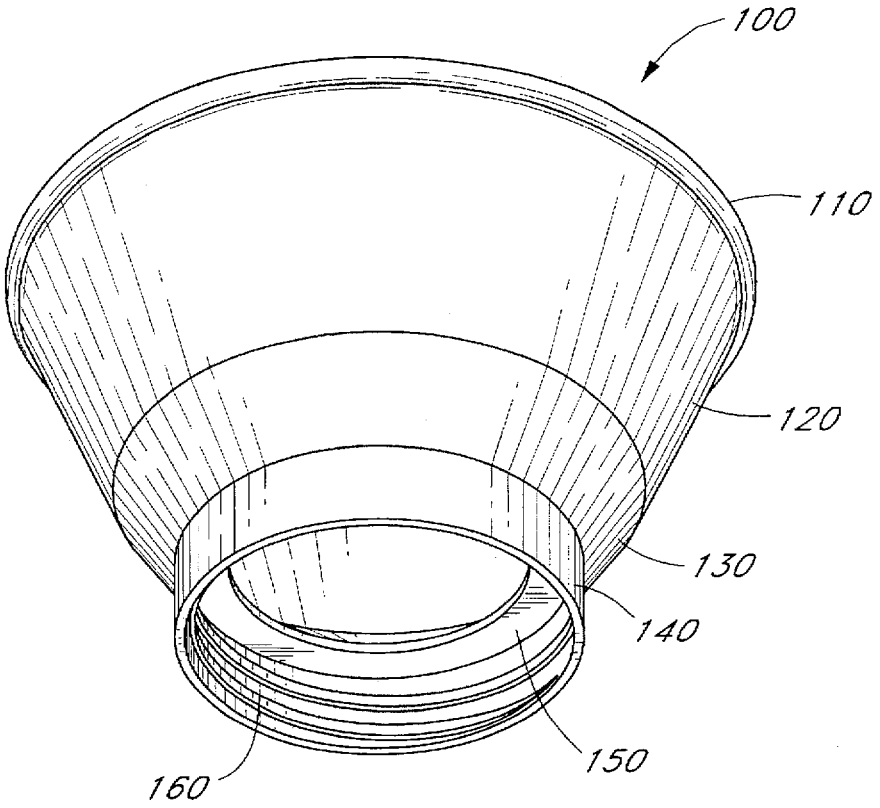
FIG. 1 illustrates a perspective from the bottom of one embodiment of a funnel, made in accordance with the teachings of the present invention.

FIG. 1 depicts a lower perspective view of one embodiment of a funnel 100 of the present invention. In this embodiment the funnel has an upper part with two segments and a lower part, as depicted in FIG. 1; an upper part with an upper hollow, conical segment 120 with a smooth rim 110 and a small angle to the vertical; a lower hollow, conical segment 130 with a larger angle to the vertical than the top segment 120; and a lower, cylindrical part 140.

Figure 2:
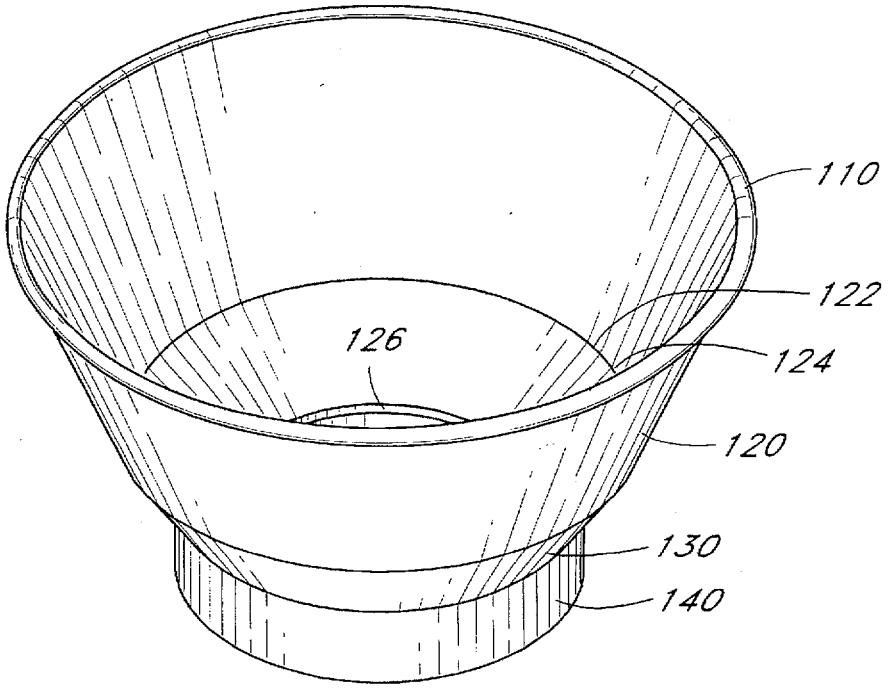
FIG. 2 illustrates a perspective from the top of the embodiment of the funnel of FIG. 1.

As illustrated in FIG. 2, the upper rim 110 of the upper conical segment 120 forms the input opening for the funnel at the upper end of the funnel 100. The upper rim 110 is optional, but provides a smooth working surface along the upper edge of the upper conical segment 120. In the present embodiment, the upper rim has the form of a bead or round portion extending along the entire periphery of the upper edge of the upper conical segment 120. Advantageously, the rim 110 joins smoothly with the upper conical segment 120. Smooth transitions provide for simple cleaning and avoid areas which might trap substances for which the funnel is used. It should be noted that although the rim 110 of the funnel is shown as circular, other shapes could also be used such as oval.

The upper conical segment 120 has a height of about two inches in the present embodiment. However, a shorter or taller height is also appropriate. As depicted in FIGS. 1 and 2, the upper conical segment 120 tapers from a larger diameter at the top rim 110 to a smaller diameter at a lower opening 122 of the upper conical segment. In one embodiment, the upper rim of the upper conical segment 120 has an inside diameter of about 4.75", and the upper conical segment has a height of about 1.9". Also, in one embodiment, the lower opening of the upper conical segment has a diameter of approximately 3.5." However, these diameters are not restrictive. In addition, as mentioned above, the upper rim 110 could have an oval or other non-circular shape. In such an embodiment, the shape advantageously transitions to a circular shape as the funnel extends to the threaded cylindrical portion 140.

The lower opening 122 of the upper conical segment 120 joins smoothly with the lower conical segment 130. Again, a smooth transition, particularly within the funnel 100, provides for easy cleaning and avoids trapping spaces for substances used with the funnel.

Figure 3:
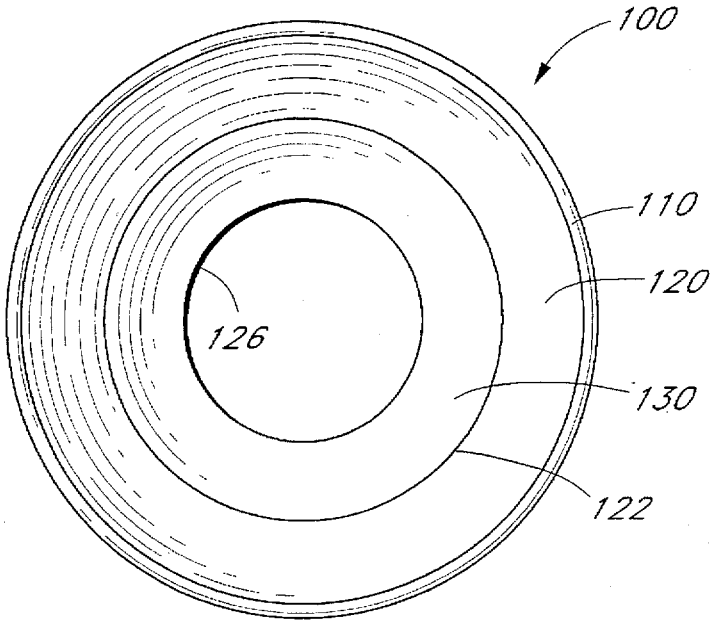
FIG. 3 is the top view of the embodiment of the funnel of FIG. 1.
Figure 4:
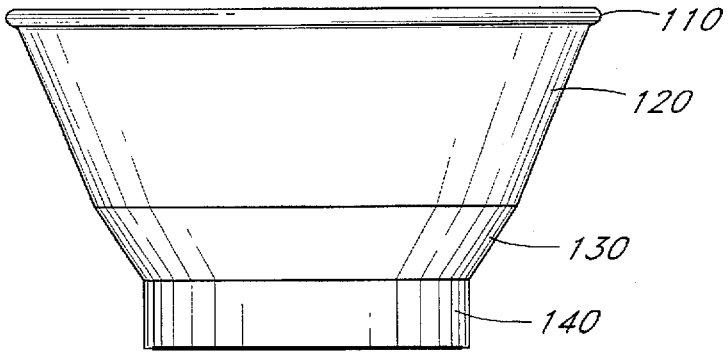
FIG. 4 is the side view of the embodiment of the funnel of FIG. 1.

In the present embodiment, the lower conical segment 130 has a first diameter at its top opening 124 (which is equivalent to the bottom opening 122 of the upper conical segment) and transitions to a second smaller diameter at a lower segment lower opening 126. The lower opening 126 is illustrated in FIG. 3, which is a top plan view of the funnel 100 of FIG. 1. In the present embodiment, the middle segment 130 has a height that is less than the height of the upper conical segment 120. In the present embodiment, the height of the upper conical segment 120 is about 1⅞." Also, in the present embodiment, the height of the middle segment 130 is about ½". However, these height are in no way restrictive, and can be varied.

In the present embodiment, the lower opening 126 of the lower conical segment 130 forms the output opening for the funnel. In other words, it is through the opening 126 that the substance for which the funnel 100 is used exits the conical funnel and enters a jar or the like.

Figure 6:
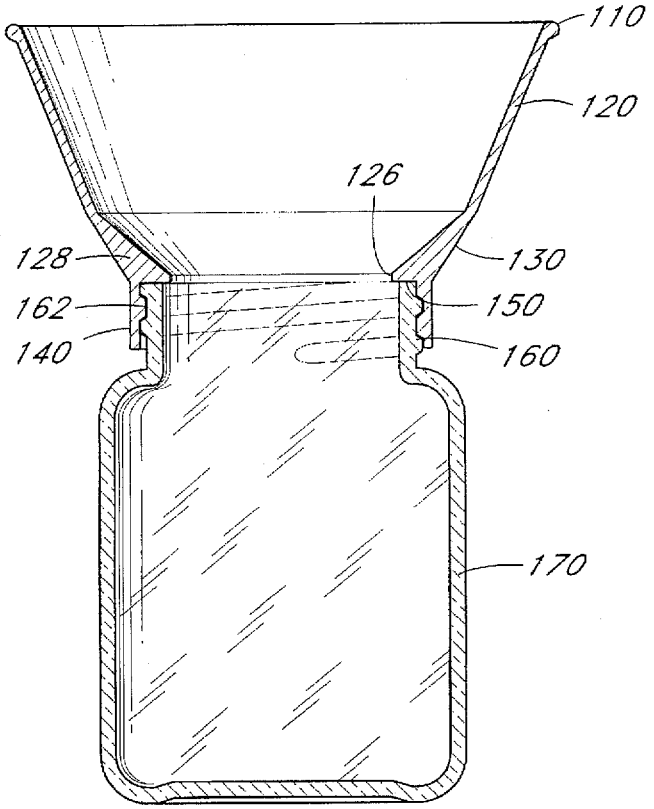
FIG. 6 is the sectional side view of the embodiment of the funnel of FIG. 1, fitted to a jar shown in phantom.

FIG. 6 illustrates a cross sectional view of the funnel 100 screwed onto a jar 170. As illustrated in FIG. 6, the wall 128 of the lower segment 130 varies in thickness from the upper opening 124 of the lower segment to the lower opening 126 of the lower segment. In the present embodiment, the thickness of the wall of the lower conical segment 130 is greater at the lower opening 126 than at the upper opening 124. Thus, the angle of the inner surface of the lower segment 130 has a greater angle with respect to vertical than the outer surface, as illustrated in the cross-section of FIG. 6.

Figure 5:
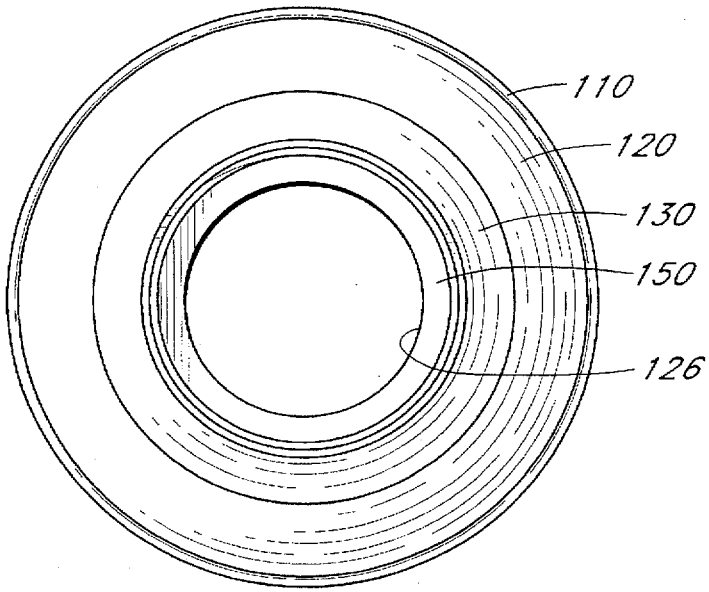
FIG. 5 is the bottom view of the embodiment of the funnel of FIG. 1.

The variation in wall thickness in the lower conical portion 128 provides for formation of a substantially planar capping rim surface 150 with a smooth inner surface. The capping rim surface 150 is illustrated in FIG. 5, which is a bottom plan view of the funnel 100, and is illustrated in the cross section of the funnel 100 of FIG. 6. In an alternative embodiment, a gasket is also provided below the capping rim surface 150 to fit between the capping rim surface 150 and the jar 170 or the like.

The lower, cylindrical part 140 is best illustrated in FIGS. 1 and 6. As illustrated in FIGS. 1 and 6, the lower cylindrical part 140 has threads 160 on its inner surface. In the present embodiment, the lower cylindrical part 140 is approximately ¾" in height and has an inside thread diameter to match the outside thread diameter of a jar or other threaded container.

As illustrated in FIG. 6, the thickness of the wall 162 of the lower cylindrical part is less than the thickness of lower end of the wall 128 of the lower segment 130. The lower cylindrical part also joins the lower segment smoothly along the outside diameter of the lower edge of the lower segment 130. In this manner, the capping rim surface 150 meets the threads 160 of the lower cylindrical part 140 at the top of the threads. In the present embodiment, the lower, cylindrical part 140 is substantially cylindrical in shape having a smooth outer surface with the threads 160 on the inner wall surface. However, for alternative applications, the funnel could be formed with threads on the outside wall for a container or the like with threads on the inside of the container mouth.

In the present embodiment, the entire funnel is advantageously one contiguous piece of machined material such as lightweight aluminum, or molded material such as plastic. The funnel could also be formed from sheet aluminum or metal. In other embodiments, the funnel 100 is made from other semi-rigid materials which are readily formed in the shape of a funnel. The entire funnel 100 could also be formed of multiple segments bonded together.

In an alternative embodiment, a gasket is also provided to fit against the rim portion 150 and within the lower, hollow cylindrical part 140. The rim portion 150 is also in the form of a gasket abutting the inner surface of the lower, hollow cylindrical part 140. In alternative embodiments, the threads 160, the rim 150 and a gasket are provided on the outside of the lower, hollow cylindrical part 140.

As illustrated in FIG. 6, the present embodiment is adapted for attachment to a jar 170. The jar 170 shown in FIG. 6 is a home canning jar, such as those made by MASON, BALL or KERR. Sometimes, other types of conventional jars are also used for home canning. Such jars are commonly used for canning jams, jellies, preserves, fruits, vegetables, and meats. However, present funnels for such jars are sloppy and suffer from poor fit and the potential for frequent spills as the food is poured into the jar 170.

In accordance with the present invention, the jar funnel 100 screws snugly to the threads of the canning jar 170. Advantageously, the lower inner opening 126 diameter of the lower segment 130 is equal to or smaller than the inner diameter of the rim of the jar 170. In this manner, food poured through the funnel 100 into the jar 170 does not significantly leak along the threads 160 of the funnel 100 and the threads of the jar. In an embodiment where a gasket (not shown), such as a rubber or silicon washer or the like, is also provided between the rim surface 150 and the rim of the jar 170, a very tight seal is achieved. However, even without a gasket, a snug fit is obtained, particular if softer materials such as plastic are used for the funnel.

The shape of the funnel 100 can vary significantly from the shape depicted in FIGS. 1-8. In addition, a finger tab or hang tab can be provided for the funnel along the outside of the upper rim 110. The double cone shape of the present embodiment provides an aesthetically pleasing appearance, a large funnel capacity and a smooth flow of the contents through the funnel.

The invention may be embodied in other specific forms without departing from its spirit or essential characteristics. For instance, other configurations which provide for a firm attachment to the mouth of a jar are also contemplated.

Figure 7:
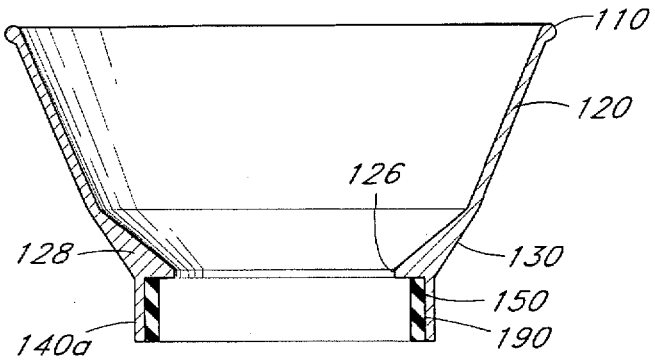
FIG. 7 is a sectional side view of an alternative embodiment of a funnel in accordance with the present invention.

FIG. 7 illustrates one such alternative embodiment. As depicted in FIG. 7, a rubber or other pliable material 190 is bonded or otherwise provided along the interior of a lower cylindrical portion 140*a*. The rubber provides a snug fit with the jar threads. With material that is significantly pliable, the material 190 takes the form of the jar threads when attached to a jar. In this manner, the pliable material 190 firmly attaches the funnel to the jar.

In an embodiment where the entire funnel is made from plastic, the plastic itself can be pliable enough such that a separate material 190 need not be provided. In other words, the plastic provides a fixing or engaging member for firm attachment of the funnel to the jar. In either embodiment, the inside opening diameter of the lower cylindrical portion 140 of the funnel is advantageously smaller than the outermost diameter of the threads of the jar mouth. This allows firm attachment to the jar.

Figure 8:
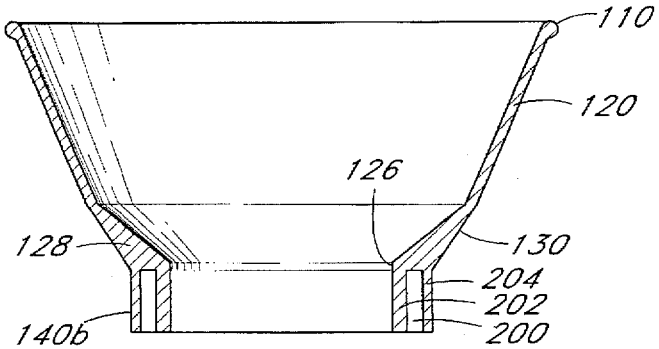
FIG. 8 is a sectional side view of another alternative embodiment of a funnel in accordance with the present invention.

In yet another embodiment, depicted in FIG. 8, a lower cylindrical portion 140*b* forms a channel 200 with an inner wall 202 and an outer wall 204. The channel 200 is sized to provide an engagement member for the funnel to attach the funnel firmly to the jar. In the embodiment of FIG. 8, a pliable material could also line one or more of the channel walls 202, 204 to provide firm attachment. For instance, rubber or plastic could be used. Advantageously, the channel 200 is slightly thinner than the maximum thickness of the mouth of the jar in order to provide firm attachment.

In yet another embodiment, a spring mechanism or the like is provided as part of the funnel such that the spring holds the funnel to the jar. All members which firmly attach the funnel to a jar are intended within the scope of this invention.

Accordingly, the described embodiments are to be considered in all respects only as illustrative and not restrictive. The scope of the invention is therefore indicated by the appended claims rather than by the foregoing description. All changes which come within the meaning and range of equivalency of the claims are to be embraced within that scope.

What is claimed is:

1. A funnel for use with home food canning jars comprising:

an upper part comprising an upper funnel wall forming an upper funnel passageway, said upper part having an upper opening adapted to receive food for canning and having a lower opening, said upper opening at least as large as said lower opening, said upper part comprising an upper segment and a lower segment, said upper and lower segments conical in shape, said lower segment having a larger angle with respect to vertical than the upper segment; and a lower part comprising a lower funnel wall having generally a tubular shape with a central axis and being joined with said upper part at said lower opening, an inner diameter of said lower funnel wall being so dimensioned to snugly fit over the mouth of the home food canning jar, said lower funnel wall having an internal thread that corresponds to an external thread on the mouth of said home food canning jar, and an inner rim positioned toward an upper end of the lower part and projecting toward the central axis, said inner rim defining an unobstructed exit opening to permit passage of said food for canning, said exit opening having a diameter sized to substantially match an inner diameter of the mouth of said home food canning jar.

2. The funnel of claim 1, wherein said upper opening has a smooth rim.

3. The funnel of claim 1, wherein said upper opening of said upper part is larger than the lower opening of said upper part.

4. The funnel of claim 1, wherein said funnel is formed as an integral funnel.

5. The funnel of claim 1, wherein said entire funnel is molded as a single piece of plastic.

6. The funnel of claim 1, further comprising a sealing gasket positioned adjacent said rim.

7. A funnel for use with home food canning jars comprising:

an upper part comprising an upper funnel wall having a generally conical shape forming an upper funnel passageway, said upper part having an upper opening adapted to receive food for canning and having a lower opening, said upper opening larger than said lower opening; and a lower part comprising a lower funnel wall having a generally tubular shape with a central axis and being joined with said upper part at said lower opening, an inner diameter of said lower funnel wall being so dimensioned to snugly fit over the mouth of the home food canning jar, said lower funnel wall having an internal thread that corresponds to an external thread on the mouth of said home food canning jar, and an inner rim positioned toward an upper end of the lower part and projecting toward the central axis, said inner rim defining an unobstructed exit opening to permit passage of said food for canning, said exit opening having a diameter sized to substantially match an inner diameter of the mouth of said home food canning jar.

8. The funnel of claim 7, wherein said upper funnel wall has a smooth interior surface.

9. The funnel of claim 7, wherein said upper opening has a smooth rim.

10. The funnel of claim 7, wherein said funnel is formed as an integral piece.

11. The funnel of claim 7, further comprising a sealing gasket positioned adjacent said rim.

* * * * *